US005100045A

United States Patent [19]

Wiand

[11] Patent Number: 5,100,045

[45] Date of Patent: Mar. 31, 1992

[54] METHOD OF RECONDITIONING BRAZED DIAMOND ABRASIVE TOOLS

[76] Inventor: Ronald C. Wiand, 18500 Fairway Dr., Detroit, Mich. 48221

[21] Appl. No.: 253,393

[22] Filed: Oct. 3, 1988

Related U.S. Application Data

[63] Continuation of Ser. No. 933,229, Nov. 20, 1986, abandoned.

[51] Int. Cl.[5] ..... B24D 18/00; B23K 1/19

[52] U.S. Cl. ..... 228/119; 228/124; 228/191; 51/295; 51/307

[58] Field of Search ..... 228/119, 121, 122, 124, 228/188, 191, 263.12; 29/402.09, 402.13, 402.16, 402.18; 51/295, 307-309; 164/92.1, 97, 108; 427/26

[56] References Cited

U.S. PATENT DOCUMENTS

| | | | |
|---|---|---|---|
| 2,562,587 | 7/1951 | Swearingen | 228/124 |
| 3,293,012 | 12/1966 | Smiley et al. | 228/121 |
| 3,372,010 | 3/1968 | Parsons | 228/121 |
| 3,663,191 | 5/1972 | Kroder | 427/26 |
| 3,751,283 | 8/1973 | Dawson | 228/122 |
| 3,918,217 | 11/1975 | Oliver | 51/309 |
| 4,413,765 | 11/1983 | Tracy | 228/119 |

FOREIGN PATENT DOCUMENTS

| | | | |
|---|---|---|---|
| 3042643 | 7/1981 | Fed. Rep. of Germany | 51/307 |
| 3234708 | 3/1984 | Fed. Rep. of Germany | 228/119 |

OTHER PUBLICATIONS

Scientific American, "There is No Sand in Sandpaper", pp. 216, 217, Nov. 1933.

Welding Journal, "Worn Metal Parts Rebuilt at Fraction of Original Cost", p. 354, vol. 50, No. 5, May 1971.

*Primary Examiner*—Samuel M. Heinrich

*Attorney, Agent, or Firm*—Harness, Dickey & Pierce

[57] ABSTRACT

A method for reconditioning diamond abrasive generator wheels having a layer of diamond particles brazed to the grinding surface involves heating the braze, binding the diamond particles above the liquid melting point, reorienting the diamond particles to increase their abrasive effect, then cooling the braze with the reoriented diamond particles until it resolidifies.

7 Claims, 1 Drawing Sheet

METHOD OF RECONDITIONING BRAZED DIAMOND ABRASIVE TOOLS

This is a continuation of U.S. patent application Ser. No. 933,229, filed Nov. 20, 1986, now abandoned.

BACKGROUND AND SUMMARY OF THE INVENTION

This invention relates to abrasive tools. More particularly, this invention relates to a method for reconditioning diamond abrasive generator wheels which are used for grinding ophthalmic lenses to a desired curvature.

Generator wheels are used in the ophthalmic industry to grind the desired curvature in ophthalmic lenses which are then fined and polished. Conventionally, generator wheels are somewhat cup-shaped with a single layer of diamond particles brazed or otherwise attached to the rim or radius of the cup to provide a grinding surface. During use, the diamond particles become worn and eventually the generator wheel must be replaced. Although the diamond and braze can be stripped and replaced with new diamond particles and braze, usually the wheel is discarded and replaced with a new diamond ophthalmic generator wheel.

In accordance with the method of the present invention, however, it has been found that worn diamond ophthalmic generator wheels can be reconditioned. Thus, it has been found that a worn abrasive tool, and in particular, a worn diamond generator wheel, having a plurality of abrasive particles bonded to a substrate by a meltable binder can be reconditioned by heating the meltable binder to a temperature at which it is liquid, reorienting the worn abrasive particles to increase their abrading effectiveness and allowing the braze to cool to bond the particles to the substrate. Preferably, additional braze paste and diamond particles are added to the substrate before heating and the new braze flows and combines with the old braze during the heating step. Also preferably, a magnetic field is employed to reorient the diamond particles.

DESCRIPTION OF THE INVENTION

Figure 1:
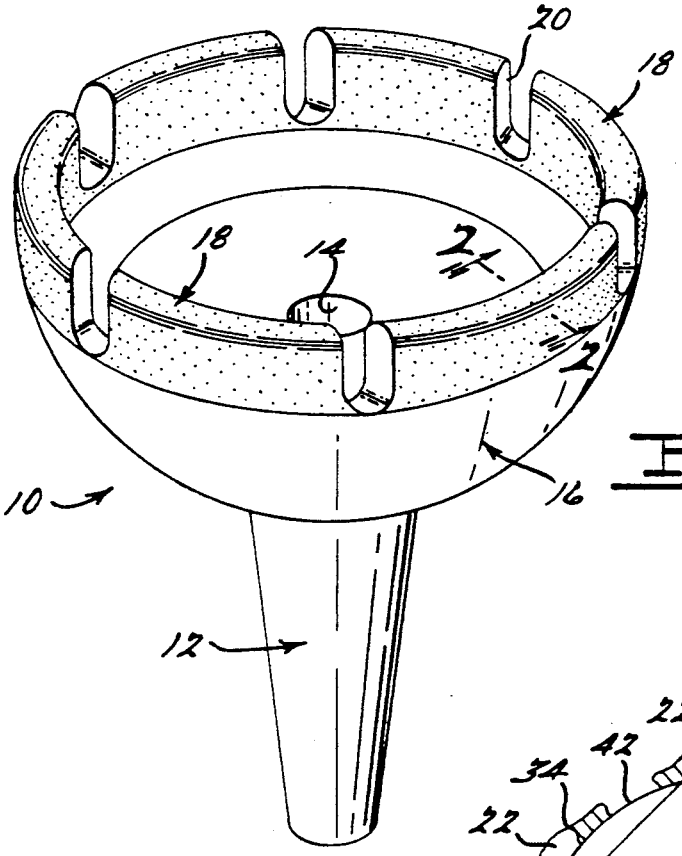
FIG. 1 is a perspective view of a worn ophthalmic diamond generator wheel.
Figure 2:
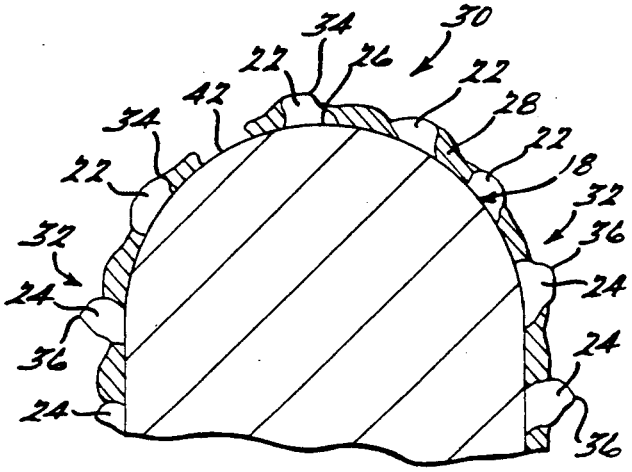
FIG. 2 is a sectional view, broken away, taken along line 2—2 in FIG. 1 and showing the radius of the wheel.

Now referring to the figures, a worn ophthalmic diamond generator wheel is shown in FIGS. 1 and 2 and indicated generally by the numeral 10. Generator wheel 10 is a conventional slotted generator wheel commonly used in the ophthalmic lens industry for grinding lenses. Generator wheel 10 has a taper 12 with an axially-extending internal bore 14 and a bell 16 with a radius or grinding section 18 with a plurality of slots 20 therein. A mono layer of a diamond abrasive particles 22 and 24 is bonded to surface 26 of radius 18 by braze metal 28.

As is well known in the industry, the diamond particles on the radius of a generator wheel become worn during lens grinding operations. Diamond particles 22 on the end portion 30 of the radius generally wear more than the diamond particles 24 on the sides 32 of the radius. Thus, as best illustrated in FIG. 2, diamond particles 22 are well-worn and have outwardly-facing edges 34 which would have little abrasive effect. Diamond particles 24 are not substantially worn and have edges 36 which would have satisfactory abrasive effect. This wear pattern typically reflects that commonly found in the industry.

In accordance with the method of the present invention, an abrasive tool having a plurality of abrasive particles bonded to a substrate by a meltable binder is reconditioned by the steps of:

(A) heating said meltable binder to a temperature at which said binder is in a liquid state;

(B) reorienting said abrasive particles an amount sufficient to increase their abrasive effect; and (C) cooling said meltable binder to a temperature at which said meltable binder is solid.

Figure 3:
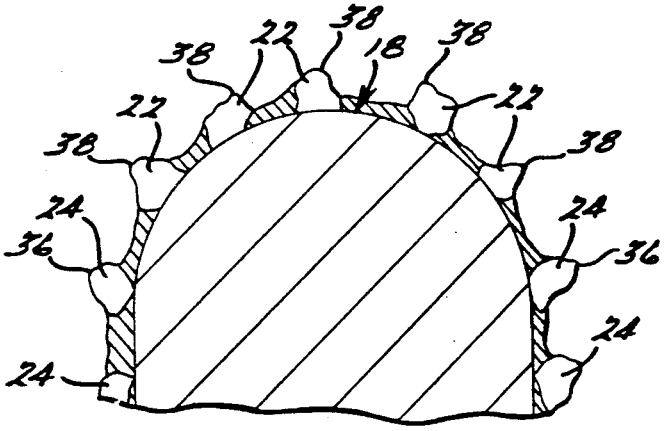
FIG. 3 is a sectional view, broken away, similar to FIG. 1 but showing the radius after the method of the present invention.

Thus, diamond generator wheel 10 can be reconditioned by first heating to a temperature at which braze 28 is liquid. The exact time of heating is not critical, for example, about 10 minutes has been found to be suitable and, as illustrated in FIG. 3, diamond particles 22 are reoriented an amount sufficient to present an increased number of abrading edges 38 to thereby increase the abrading of abrasive particles 22. Finally, diamond generator wheel 10 is allowed to cool and braze 28 solidifies, thus firmly bonding diamond particles 22 and 24 to braze 28 and hence to the surface 20 radius 18. The heating step also preferably reduces the thickness of the braze to further expose more diamond abrasive edges.

Figure 4:
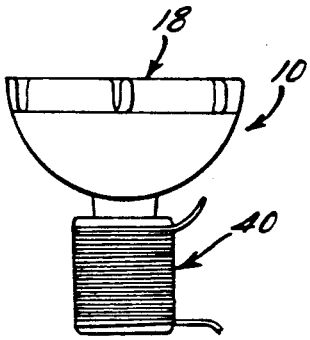
FIG. 4 is a side elevation of an ophthalmic diamond generator wheel in association with an electromagnetic coil as used in a preferred embodiment of the method of this invention.

Although the diamond particles will tend to reorient themselves simply upon heating the braze to a liquid state, in a preferred method of this invention, diamond particles 22 are ferromagnetic and are reoriented by means of a magnetic field. As illustrated in FIG. 4, an electromagnetic coil 40 can be coaxially applied over taper 12 of a wheel 10 comprised of ferromagnetic metal. When electric current is passed through, coil 40 will magnetize wheel 10. The resulting magnetic field will reorient diamond particles 22 an amount sufficient to increase their abrading effect.

It will be appreciated by those skilled in the art that some diamond generator wheels 10 will be so worn as to have bare spots 42, for example, where diamond particles have broken away during use. Also, some diamond particles 22 will have been worn down to an extent as to have no more useful abrading life even when reoriented. In such cases, additional, new diamond particles and braze are placed on the radius of the wheel prior to the heating step. Optionally, a binder may be employed to hold the diamond particles and braze alloy in place. Then, during heating, the new braze and old braze flow to an extent sufficient to blend together and flow to follow the original curvature of the radius. Upon cooling, the particles are bound to the radius.

The heating step is preferably carried out in a vacuum furnace. Brazes suitable for use in the method of the present invention are well known in the art and include, for example, Nicrobraze® L.M. available commercially from Wall Colmonoy Corporation. Other suitable brazes are disclosed in U.S. Pat. No. 3,894,673, July 15, 1975 to Lowdes, et al., the disclosure of which is specifically incorporated by reference herein. Diamond particles for use herein are also well known in the art.

Further understanding of the present invention will be had from the following specific example.

EXAMPLE 1

A worn-out slotted diamond generator wheel, as shown in FIG. 1, is cleaned using a rotating wire brush and sandblasted. The radius of the wheel has several small areas where diamond particles have broken away, i.e., bald spots. Brazing powder and a binder are mixed to form a brazing paste which is placed on the radius of the wheel to cover the bald spots. Then 40/60 mesh synthetic diamond crystals are placed on the paste. The binder is binder N.B.S. and the brazing powder is Nicrobraze® L.M., both from Wall Colmonoy Corporation of Detroit, Mich. Nicrobraze® L.M. has the following composition:

| Ingredient | % By Weight |
|---|---|
| Cr | 7.0 |
| B | 3.1 |
| Si | 4.5 |
| Fe | 3.0 |
| C | 0.06 or less |
| Ni | balance |

The wheel is placed in a conventional vacuum furnace used for brazing and is heated to about 1900° F., about 70° F. above the liquid melting point or flow point of the braze. The new and old braze become thermoplastic and the old and new diamond particles reorient, i.e. roll, themselves on the radius to present new abrading edges. The brazes flow together. The thickness of the braze is slightly less than that of the original braze. The wheel is then used to generate an ophthalmic lens in a conventional and satisfactory manner.

EXAMPLE 2

The procedure of Example 1 is followed except that a coil of wire is placed coaxially over the taper of the wheel as illustrated in FIG. 4 before the heating step. The wire is a 12-gauge copper wire of a total (uncoiled) length of about 25 feet. The coil is about 2 inches in diameter.

A 5-ampere, 12-volt DC power supply is electrically connected to the respective end of the coil wire and current is passed therethrough as the braze is heated to about 50° F. above its melting point. The current provides a magnetic field which causes slight motion and reorientation of the diamond particles.

Which the present invention has been described in terms of the preferred embodiment of a diamond generator wheel, it will be appreciated that the invention can be broadly applicable to other abrasive tools. It will also be appreciated that the present invention is subject to variation and modification within the scope of the invention which is intended to be limited only by the following claims.

What is claimed is:

1. The method of reconditioning an abrasive tool having a plurality of abrasive particles bonded to a substrate by a meltable binder comprising the steps of:

(A) heating said meltable binder to a temperature at which said material is liquid;

(B) reorienting said abrasive particles an amount sufficient to increase their abrasive effect; and (C) cooling said meltable binder to a temperature at which said binder is solid.

2. The method of claim 1 including the additional steps of placing additional abrasive particles and meltable binder on said substrate before carrying out said heating step.

3. The method of claim 2 wherein said abrasive tool is a generator wheel and said abrasive particles are diamond particles.

4. The method of claim 3 wherein said meltable binder is a metal braze composition.

5. The method of claim 4 wherein said abrasive particles are repositioned by subjecting said particles to a magnetic field.

6. The method of claim 5 wherein said braze composition comprises at least about 2% chromium, and at least about 60% of one of the metals selected from the group consisting of nickel and cobalt and mixtures thereof.

7. The method of claim 6 wherein said metal braze composition is heated in said heating step to a temperature at least 50° F. greater than the liquid melting point temperature of said braze.

* * * * *